US005652403A

United States Patent [19]

Sugiyama et al.

[11] Patent Number: 5,652,403

[45] Date of Patent: Jul. 29, 1997

[54] KEYBOARD MUSICAL INSTRUMENT ALLOWING PLAYER TO PERFORM ENSEMBLE TOGETHER WITH ELECTRONIC SOUND SYSTEM

[75] Inventors: Nobuo Sugiyama; Haruki Uehara, both of Shizuoka-ken, Japan

[73] Assignee: Yamaha Corporation, Japan

[21] Appl. No.: 631,270

[22] Filed: Apr. 12, 1996

[30] Foreign Application Priority Data

Apr. 19, 1995 [JP] Japan ..... 7-094062

[51] Int. Cl.[6] ..... G10F 1/02; G10H 1/053

[52] U.S. Cl. ..... 84/708; 84/719; 84/3; 84/171; 84/DIG. 4

[58] Field of Search ..... 84/631, 644, 664, 84/670, 708, 719, 720, 744, 745, 2, 3, 171, 423 R, DIG. 4

[56] References Cited

U.S. PATENT DOCUMENTS 4,744,281 5/1988 Isozaki ..... 84/DIG. 4

*Primary Examiner*—Stanley J. Witkowski

*Attorney, Agent, or Firm*—Graham & James LLP

[57] ABSTRACT

A keyboard musical instrument has an upright piano, an automatic playing system for exerting forces on the keys of the upright piano instead of a player on the basis of music data codes and an electronic sound generating system for generating electronic sounds from the music data codes, and a player can perform an ensemble through a fingering on the keyboard of the upright piano together with the electronic sound generating system.

9 Claims, 8 Drawing Sheets

KEYBOARD MUSICAL INSTRUMENT ALLOWING PLAYER TO PERFORM ENSEMBLE TOGETHER WITH ELECTRONIC SOUND SYSTEM

FIELD OF THE INVENTION

This invention relates to a keyboard musical instrument and, more particularly, to a keyboard musical instrument which allows a player to perform an ensemble together with an electronic sound system.

DESCRIPTION OF THE RELATED ART

An automatic player piano is a kind of keyboard musical instrument, and stores music data codes in a data recording medium such as a floppy disk. The music data codes are sequentially read out from the data recording medium, and solenoid-operated actuators selectively pull down the keys and the pedals instead of a player.

FIG. 1 illustrates a sub-routine program sequence executed by a processing unit (not shown) incorporated in the automatic player piano in a playback. When the processing unit fetches a music data code, the control is branched to from a main routine program to the sub-routine program sequence illustrated in FIG. 1 of the drawings. The processing unit checks the music data code to see whether or not the music data code is representative of a piece of key event data information such as a key-on event or a key-off event as by step SP1.

If the answer at step SP1 is given affirmative, the processing unit proceeds to step SP2, and instructs a current driving circuit (not shown) to energize a solenoid of one of the solenoid-operated actuators (not shown) associated with a key (not shown) identified by the music data code. The solenoid-operated actuator unit projects the plunger so as to move the key downwardly. The force exerted on the key is transferred through a key action mechanism to a hammer assembly, and the hammer is driven for rotation toward the associated string. The hammer strikes the string, and the string vibrates for generating an acoustic sound. Then, the processing unit returns to the main routine.

On the other hand, if the answer at step SP1 is given negative, the processing unit proceeds to step SP3, and executes a job or task represented by the music data code. A control of one of the pedals (not shown) is an example of the job. Upon completion of the job, the processing unit returns to the main routine program.

Thus, the processing unit controls the reproduction of a performance in the playback mode of operation. However, while the processing unit is controlling the solenoid-operated actuators, a human player can not participate the reproduction, and user requests the manufacturer to develop a keyboard musical instrument which allows a player to freely participate the reproduction.

Japanese Patent Application No. 4-174813 proposed a silent mechanism for an acoustic piano, and U.S. Ser. No. 08/073,092 was filed claiming the priority right on the basis of Japanese Patent Application No. 4-174813 together with other Japanese Patent Applications. Although several prior arts opposed against U.S. Ser. No. 08/073,092, the U.S. patent application was patented, and U.S. Pat. No. 5,374,775 was issued on Dec. 20, 1994. The references cited in the patent prosecution are U.S. Patent documents U.S. Pat. Nos. 2,250,065, 4,633,753, 4,704,931, 4,744,281, 4,970,929, 5,115,705 and 5,247,129 and Foreign Patent documents 44782 (Germany), 68406 (Germany), 97885 (Germany), 3707591 (Germany) and 3707591C1 (Germany), To9-1U000077 (Italy), 51-67732 (Japan), 55-55880 (Japan), 62-32308 (Japan), 63-97997 (Japan) and 614303 (Switzerland).

The silent mechanism disclosed in U.S. Pat. No. 5,374,775 moves a stopper into and out of the paths of the hammer shanks, and the hammer shank rebounds on the stopper staying in the paths of the hammer shanks before an impact on the strings. However, the electronic sounds are generated on the basis of the fingering on the keyboard, and an ensemble is also impossible.

SUMMARY OF THE INVENTION

It is therefore an important object of the present invention to provide a keyboard musical instrument which allows a player to perform an ensemble together with a controller thereof.

To accomplish the object, the present invention proposes to reproduce electronic sounds from music data codes representative of a music so as to allow a player to play a part of a piece of music on a keyboard.

In accordance with the present invention, there is provided a keyboard musical instrument comprising: an acoustic keyboard instrument including a keyboard having a plurality of keys assigned notes of a scale and rotated with forces exerted thereon, a plurality of key action mechanisms respectively connected to the plurality of keys so as to transfer the forces therethrough, a plurality of hammer assemblies respectively associated with the plurality of key action mechanisms, and driven for rotation by the plurality of key action mechanisms transferring the forces thereto, and a plurality of vibrative means respectively struck by the plurality of hammer assemblies driven by the plurality of key action mechanisms for generating acoustic sounds having the notes; and an electric system including a plurality of actuators respectively provided for the plurality of keys and responsive to driving signals for exerting the forces on the plurality of keys, an electronic sound generating means responsive to music data codes for generating electronic sounds, and a controlling means responsive to an instruction supplied from the outside thereof so as to selectively enter into an electronic sound mode and an acoustic sound mode, the controlling means supplying the music data codes to the electronic sound generating means in the electronic sound mode, the controlling means generating the driving signals from the music data codes so as to supply the driving signals to the plurality of actuators.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Constitution of Keyboard Musical Instrument

Figure 1:
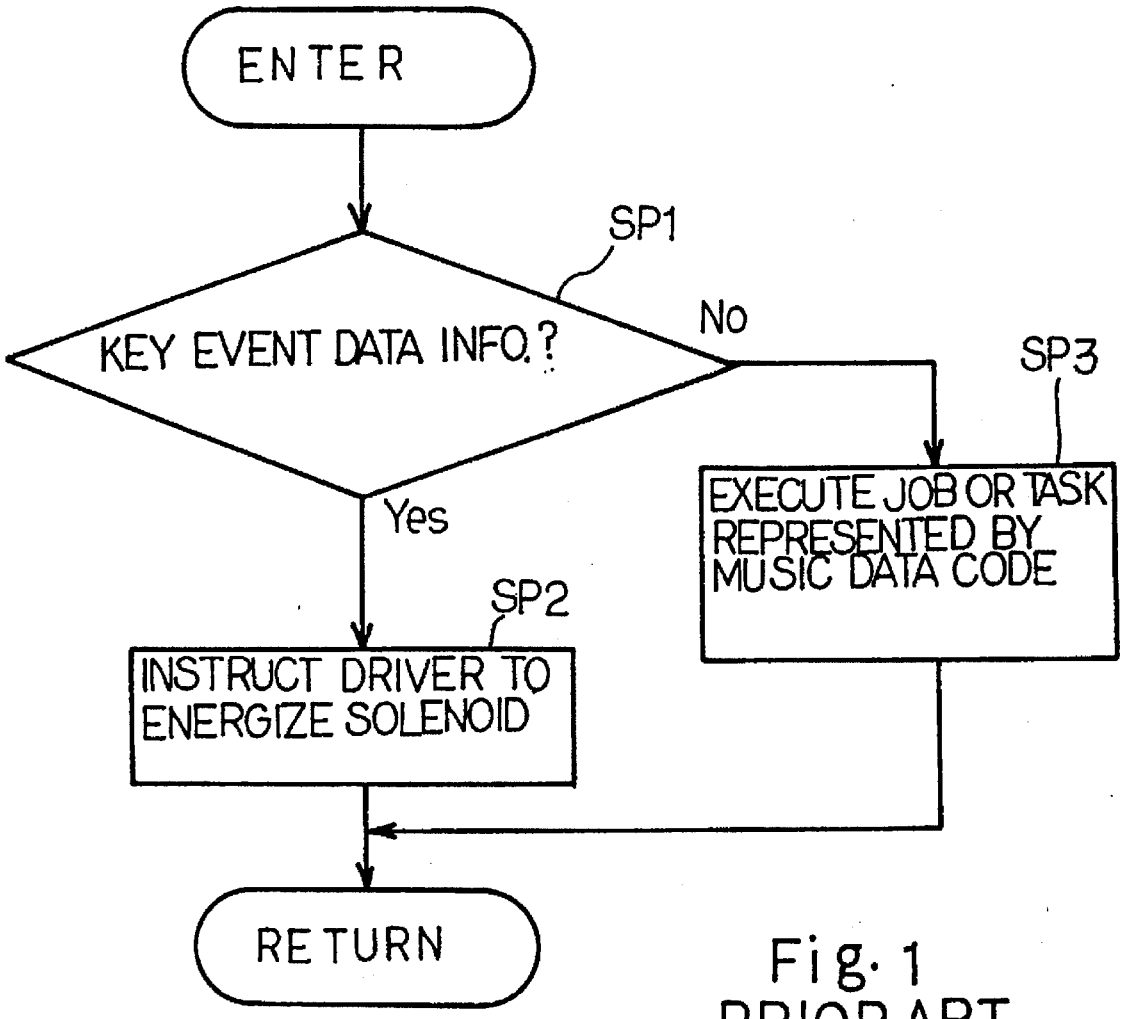
Fig. 1 PRIOR ART
FIG. 1 is a flow chart showing the sub-routine program sequence executed by the processing unit of the prior art automatic player piano.

A keyboard musical instrument embodying the present invention largely comprises an acoustic piano 1, a silent system 2, an automatic playing system 3, an electronic sound system 4, a recording system 5 and a sound reproducing system 6. The keyboard musical instrument behaves as follows.

Mode I:

The keyboard musical instrument serves as a standard piano, and the acoustic piano 1 generates acoustic sounds.

Mode II:

The silent system 2 interrupts hammer motions in the acoustic piano 1, and the electronic sound system 4 monitors the key/hammer motions so as to generate electronic sounds instead of acoustic sounds.

Mode III:

The automatic playing system 3 controls the acoustic piano 1, and the acoustic piano 1 generates acoustic sounds without a fingering of a player.

Mode IV:

The recording system 5 monitors the key/hammer motions, and generates music data codes representative of a performance with or without acoustic sounds in either Mode I or II.

Mode V:

The sound reproducing system 6 fetches the music data codes so as to generate electronic sounds, and a player can play the acoustic piano 1 so as to perform an ensemble.

In the following description, word "front" means a position closer to a player than word "rear", and directions "clockwise" and "counter clockwise" are determined on a sheet where a rotating part is illustrated.

Acoustic Piano and Silent System

Figure 2:
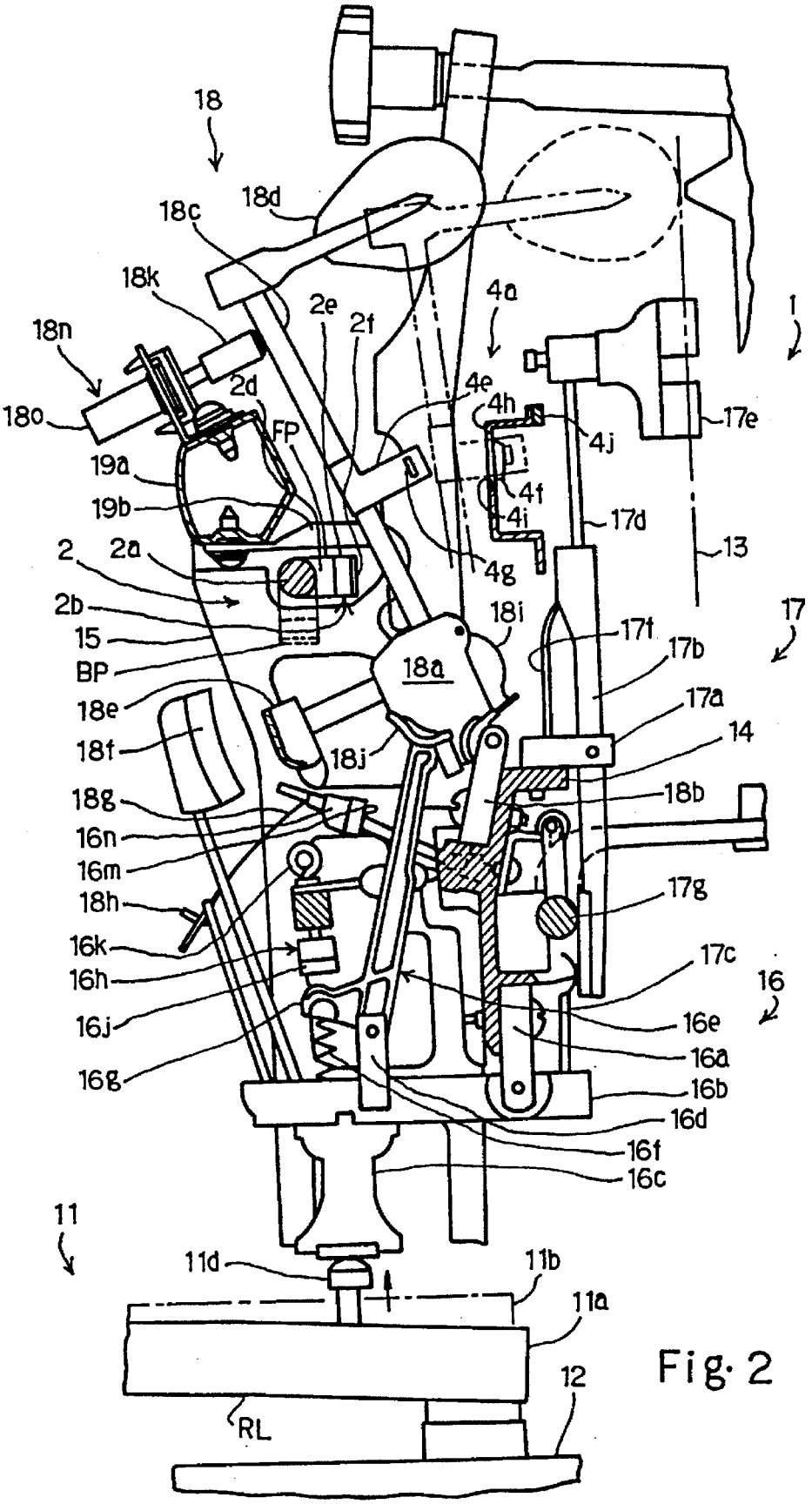
FIG. 2 is a side view showing an acoustic piano and a silent system incorporated in a keyboard musical instrument according to the present invention.

Referring to FIG. 2 of the drawings, the acoustic piano 1 is an upright piano, and comprises a keyboard 11 provided over a key bed 12. Eighty-eight black and white keys 11*a* and 11*b* form the keyboard 11, and are turnable around balance pins 11*c* (see FIG. 3). The black and white keys 11*a* and 11*b* extend in a fore-and-aft direction of the upright piano, and front end portions of the black and white keys 11*a* and 11*b* are exposed to a player. Notes of a scale are respectively assigned to the black and white keys 11*a* and 11*b*, respectively.

While a force is not being exerted by the player, the black and white keys 11*a* and 11*b* are staying in respective rest positions as indicated by real line RL. When the player depresses the black and white keys 11*a* and 11*b*, the front portions of the black and white keys 11*a* and 11*b* are downwardly moved, and arrive at respective end positions.

The upright piano 1 further comprises a plurality of sets of strings 13 provided in front of a vertically extending frame (not shown) and stretched between tuning pins (not shown) and hitch pins (not shown).

A center rail 14 is positioned in front of the strings 13, and laterally extends over the rear end portions of the black and white keys 11*a* and 11*b*. The center rail 14 is bolted to action brackets 15 at both ends and an intermediate point thereof, and the action brackets 15 are placed on the key bed 12.

The upright piano 1 further comprises a plurality of key action mechanisms 16 functionally connected to the black and white keys 11*a* and 11*b*, a plurality of damper mechanisms 17 actuated by the key action mechanisms 16 for momentarily leaving the associated sets of strings 13 and a plurality of hammer assemblies 18 driven for rotation by the key action mechanisms 16.

When the player depresses one of the black and white keys 11*a* and 11*b*, the depressed key 11*a*/11*b* actuates the key action mechanism 16 so as to rotate the hammer assembly 18, and causes the damper mechanism 17 to leave the set of strings 13. The hammer assembly 18 drive for rotation strikes the set of strings 13 in Modes I, III and V, and the strings 13 vibrate so as to generate an acoustic sound.

When the player releases the key 11*a*/11*b*, the key action mechanism 16 and the hammer assembly 18 return to the initial positions or the home positions, and the damper mechanism 17 is brought into contact with the strings 13, thereby absorbing the vibrations of the strings 13.

The key action mechanisms 16 are similar in constitution to one another, and each key action mechanism 16 includes a whippen flange 16*a* bolted to a lower end portion of the center rail 14 and a whippen assembly 16*b* rotatably connected to the whippen flange 16*a*. The whippen assembly 16*b* has a heel 16*c* held in contact with a capstan screw 11*d* implanted into the rear end portion of the black or white key 11*a*/11*b*.

The key action mechanism 16 further includes a jack flange. 16*d* upright from a middle portion of the whippen assembly 16*b*, a jack 16*e* turnably supported by the jack flange 16*d*, a jack spring 16*f* inserted between the whippen assembly 16*b* and a toe 16*g* of the jack 16*e* and a regulating button sub-mechanism 16*h* opposed to the toe 16*g*. The jack 16*e* is shaped into an L-letter configuration, and the jack spring 16*f* urges the jack 16*e* in the counter clockwise direction at all times.

While the black or white key 11*a*/11*b* is staying in the rest position, the whippen assembly 16*b* is horizontally maintained, and the toe 16*g* is spaced from the regulating button sub-mechanism 16*h*. The regulating button sub-mechanism 16*h* has a regulating button 16*j* protectable toward and retractable from the toe 16*g* by turning a regulating screw 16*k*.

If the gap between the toe 16*g* and the regulating button 16*j* is increased, the hammer assembly 18 escapes from the jack 16*e* later. On the other hand, if the gap is decreased, the hammer assembly 18 escapes earlier. A jack stop rail felt 16*m* is connected through a jack stop rail 16*n* to the center rail 14, and restricts the motion of the jack 16*e*. The jack stop rail felt 16*m* is regulable to an appropriate position.

When the toe 16*g* is brought into contact with the regulating button 16*j*, the reaction impedes the motion of the whippen assembly 16*b* and, accordingly, the depressed key 11*a*/11*b*, and the player feels the key 11*a*/11*b* heavier than before. Thus, the jack 16e and the regulating button sub-mechanism 16h deeply concern a key-touch, and the position of the regulating button 16j defines the starting point of the escape of the hammer assembly 18.

The damper mechanisms 17 are similar in constitution to one another, and includes a damper lever flange 17a fixed to an upper surface of the center rail 14, a damper lever 17b rotatably supported by the damper lever flange 17a, a damper spoon 17c implanted into the rear end portion of the whippen assembly 16b, a damper wire 17d projecting from the damper lever 107b, a damper head 17e fixed to the damper wire 17d and a damper spring 17f urging the damper lever 17b in the clockwise direction.

While the black or white key 11a/11b is staying in the rest position, the damper spoon 17c does not push the damper lever 17b, and the damper head 17e is held in contact with the set of strings 13.

When the player depresses the black or white key 11a/11b from the rest position to the end position, the capstan screw 11d pushes up the whippen assembly 16b, and the whippen assembly 16b rotated in the clockwise direction causes the damper spoon 17c to rearwardly push the damper lever 17b. As a result, the damper lever 17b is rotated in the counter clockwise direction, and the damper head 17e leaves the set of strings 13.

On the other hand, when the black or white key 11a/11b is released, the whippen assembly 16b is rotated in the counter clockwise direction, and the damper spoon 17c removes the pressure from the damper lever 17b. As a result, the damper spring 17f urges the damper lever 17b in the clockwise direction, and the damper head 17e is brought into contact with the set of strings 13 again.

The damper assemblies 17 are associated with a damper rod 17g, and is linked to a damper pedal (not shown). When the player steps on the damper pedal, the damper rod 17g causes all the damper heads 17e to simultaneously leave the sets of strings 13.

The hammer assemblies 18 are also similar in arrangement to one another. Each of the hammer assemblies 18 includes a hammer butt 18a turnably supported by a butt flange 18b fixed to the center rail 14, a hammer shank 18c upwardly projecting from the hammer butt 18a, a hammer head 18d fixed to the leading end of the hammer shank 18c, a catcher 18e projecting from the hammer butt 18a, a back check 18f implanted into the front end portion of the whippen assembly 16b, a bridle tape 18g extending from the catcher 18e, a bridle wire 18h implanted into the front end portion of the whippen assembly 16b and a butt spring 18i urging the hammer butt 18a in the counter clockwise direction.

While the black or white key 11a/11b is staying in the rest position, the top surface of the jack 16e is in contact with a butt skin 18j attached to a lower surface of the hammer butt 18a, and the hammer shank 18c is resting on a plunger 18k of an absorber 18n attached to a hammer rail 19a. The hammer rail 19a is supported through hammer rail hinges 19b by the action brackets 15.

A resilient block is housed in the holder 18o of the absorber 18n, and takes up the shock upon impact of the hammer shank 18c against the plunger 18k. Thus, the absorber 18n prevents the hammer assembly from rebound.

The bridle tape 18g links the motion of the hammer assembly 18 to the motion of the whippen assembly 16b, and does not allow the hammer assembly 18 to twice strike the strings 13.

The hammer rail hinges 19b is shaped in an L-letter configuration, and the silent system 2 is rotatable without an interference of the hammer rail hinges 19b.

Though not shown in FIGS. 1 and 2, a soft pedal is connected to the hammer rail hinges 19b, and the angular position of the hammer rail 19a is changed by manipulating the soft pedal.

The silent system 2 includes a shaft member 2a rotatably supported by side boards (not shown) and action brackets 15, cushion units 2b attached to the shaft member 2a at intervals and a motor 2c (see FIG. 4) connected to one end of the shaft member 2a. The motor 2c bi-directionally rotates the shaft member 2a, and changes the cushion units 2b between a free position FP and a blocking position BP.

The cushion units 2b in the blocking position BP are opposed to the catchers 18e, and the catchers 18e rebound thereon before the hammer heads 18d reach the strings 13. On the other hand, when the cushion units 2b are changed to the free position FP, the hammer assemblies 18 are rotated toward and rebound on the strings 13 without an interference of the cushion units 2b.

Each of the cushion units 2b includes a rigid bracket 2d fixed to the shaft member 2a, a resilient member 2e such as a felt sheet fixed to the rigid bracket 2d and a protective pad 2f attached to the resilient member 2e. The catcher 18e rebounds on the protective pad 2f, and the resilient member 2e takes up the impact of the catcher 18e.

Automatic Playing System

Figure 3:
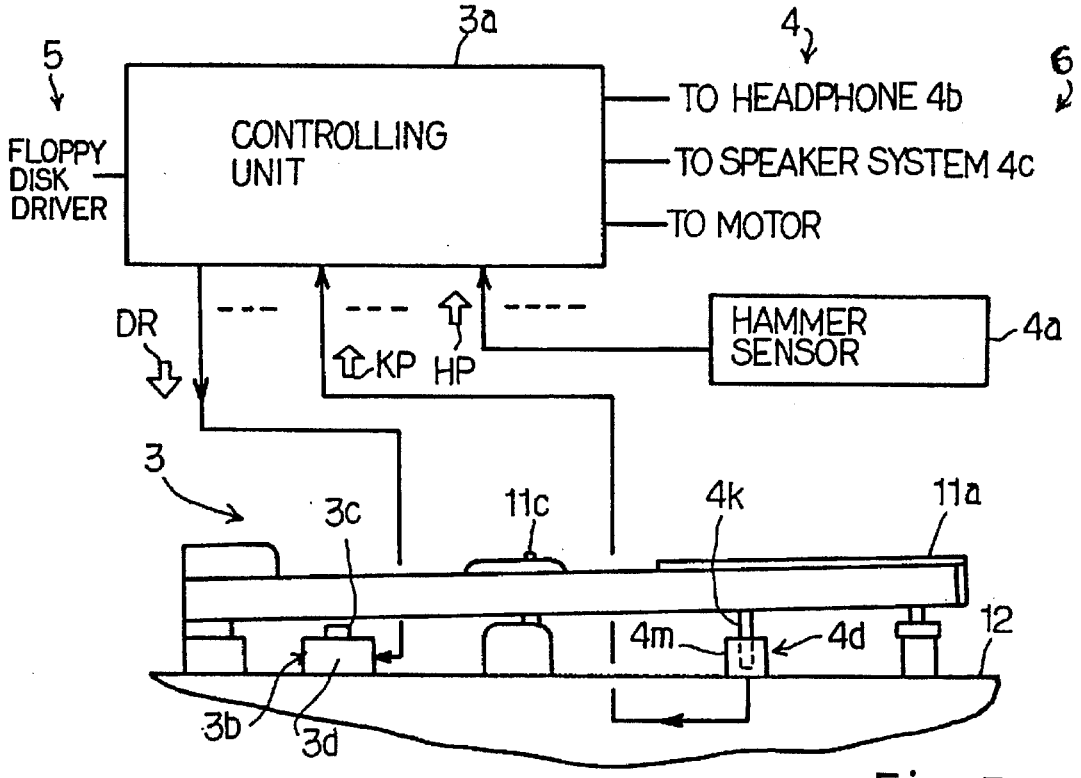
FIG. 3 is a side view showing an electronic sound system incorporated in the keyboard musical instrument according to the present invention.
Figure 6:
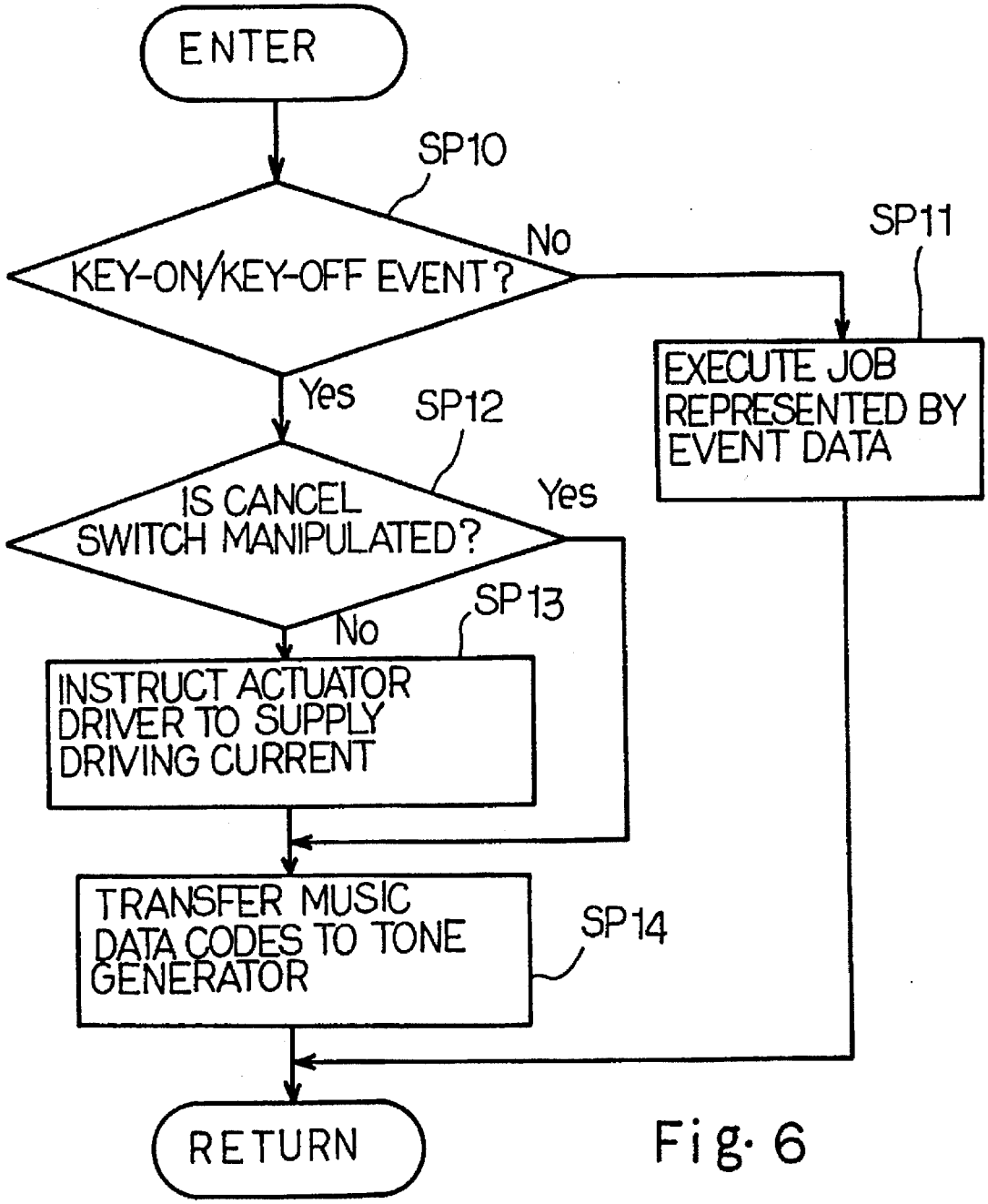
FIG. 6 is a flow chart showing a program sequence executed by a microprocessor upon a read-out of an event data.

Turning to FIG. 3 of the drawings, the automatic playing system 3 includes a controlling unit 3a, a plurality of solenoid-operated actuator units 3b respectively provided under the black and white keys 11a/11b, other solenoid-operated actuator units (not shown) provided for the damper/muffler/soft pedals (not shown) and a playback switch 7d (see FIG. 6). The controlling unit 3a is shared with the electronic sound system 4, the silent system 2 and the recording system 5, and will be described hereinlater with reference to FIG. 4.

A plunger 3c and a solenoid wound on a bobbin form in combination each of the solenoid-operated actuator units 3b, and the bobbin is accommodated in a solenoid case 3d. The solenoid cases 3d are mounted on the key bed 12 under the associated black and white keys 11a/11b, and a driving current signal DR energizes the solenoid so that the plunger 3c upwardly projects from the solenoid case 3d.

In the automatic playing mode, the controlling unit 3a sequentially fetches a series of music data codes representative of a performance, and determines the black and white keys 11a/11b to be depressed, the damper/muffler/soft pedals to be pressed down and the amount of driving current signal DR supplied to the solenoid-operated actuators associated with the selected keys 11a/11b and the selected pedals.

When the controlling unit 3a selectively supplies the driving current signals DR to the solenoid-operated actuator units 3b, the solenoid-operated actuator units 3b moves the black and white keys 11a/11b as if a pianist depresses those keys 11a/11b. The other solenoid-operated actuator units for the pedals are similarly energized by the controlling unit 3a, and selectively move the associated pedals instead of the player.

The music data codes may be stored in a floppy disk 6 (see FIG. 4) or directly supplied from another electronic system.

Electronic Sound System

Figure 5:
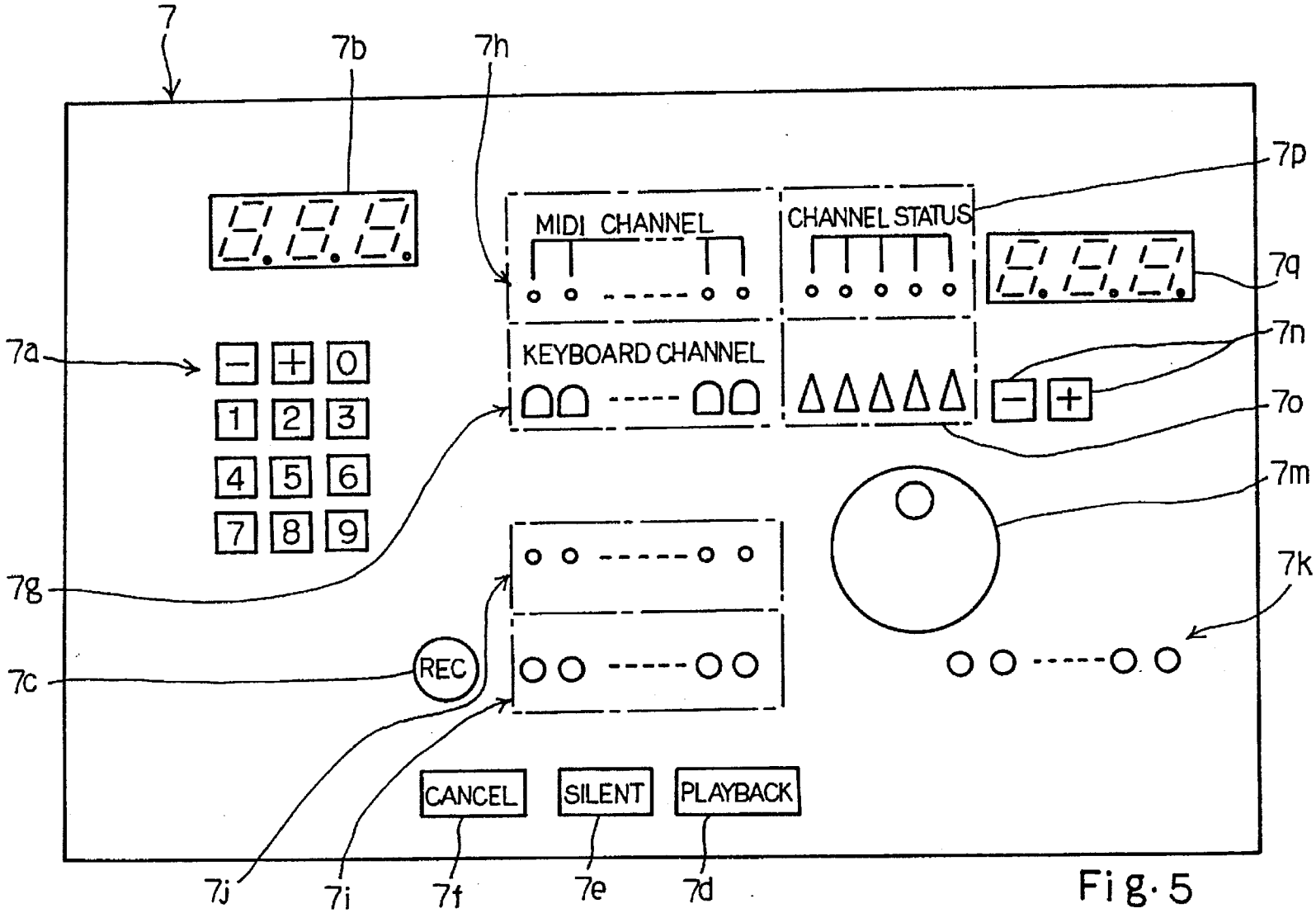
FIG. 5 is a view showing the arrangement of switches on a manipulating panel incorporated in the keyboard musical instrument.

The electronic sound system 4 includes the controlling unit 3a, a plurality of hammer sensors 4a respectively provided for the hammer assemblies 18, a head-phone 4b, a speaker sub-system 4c, a plurality of key sensors 4d for monitoring the black and white keys 11a/11b, respectively, and a silent switch 7e (see FIG. 5). In this instance, both of the head-phone 4b and the speaker sub-system 4c are incorporated in the electronic sound system 4. However, only one of the head-phone 4b and the speaker sub-system 4c may be provided for another keyboard musical instrument according to the present invention.

Turning back to FIG. 2, a shutter plate 4e and a photo-interrupter 4f as a whole constitute each of the hammer sensors 4a. A window 4g is formed in the shutter plate 4e, and the shutter plate 4e is attached to the hammer shank 18c. The photo-interrupters 4f are fixed to a rail member 4h, and the rail member 4h is supported by the action brackets 15.

A photo-emitting element (not shown), a photo-receiving element (not shown) and a pair of optical fibers coupled to the photo-emitting/photo-receiving elements form each of the photo-interrupters 4f. Slits 4i are formed in the rail member 4h at intervals, and allow the shutter plates 4e to pass therethrough. The photo-emitting/photo-receiving elements are accommodated in the controlling unit 3a.

The optical fibers of each pair are confronted with each other on both sides of the slit 4i, and the shutter plate 4e intermittently interrupts the light beam between the optical fibers. Reference sign 4j designates cushion members attached to the rear surface of the rail member 4h, and the cushion members 4j gently receive the damper wires 17d without noise.

While the hammer assembly 18 is turning toward the set of strings 13, the leading edge of the shutter plate 4e firstly intercepts the light beam, then the window 4g allows the light beam to bridge over the slit 3i again, and, finally, the boss portion of the shutter plate 4e intercepts the light beam again. Thus, the light beam is intercepted twice before the hammer head 18d strikes the strings 13 or the catcher 18e rebounds on the cushion unit 2b.

The interception of the light beam and the photo-detection through the window 4g change a hammer position signal HP (see FIG. 3). In other words, the hammer motion is detected by the associated hammer sensor 4a, and the hammer position signal HP is indicative of the current hammer position on the trajectory of the hammer assembly 18.

Turning back to FIG. 3, the key sensor 4d is implemented by a combination of a shutter plate 4k and a photo-interrupter array 4m. The shutter plate 4k is attached to the lower surface of the associated key 11a/11b, and is moved together. An upper photo-interrupter and a lower photo-interrupter are incorporated in the array 4m, and are spaced along the trajectory of the shutter plate 4k.

While a pianist is depressing the key 11a/11b, the shutter plate 4k firstly intercepts the light beam of the upper photo-interrupter, and, thereafter, the light beam of the lower photo-interrupter. On the contrary, when the pianist releases the depressed key 11a/11b, the shutter plate 4k firstly provides an optical path for the lower photo-interrupter and, thereafter, for the upper photo-interrupter.

The controlling unit 3a acknowledges the depressed key with the hammer position signal HP, and determines a timing for generating an electronic sound on the basis of the second interception of the shutter plate 4e. Moreover, the controlling unit 3a acknowledges a key-off event, i.e., the release of a depressed key through the key position signal KP supplied from the associated key sensor 4d. The key-off event is indicative of a contact timing for damping the vibration of the strings 13 with the damper head 17e.

The controlling unit 3a further estimates the intensity of impact against the strings 13 on the basis of lapse of time between the first photo-interception and the second photo-interception. This is because of the fact that the intensity of an impact is proportional to the hammer velocity during the free rotation of the hammer assembly 18. The lapse of time is inversely proportional to the hammer velocity, and the intensity of the impact is estimable on the basis of the lapse of time.

The controlling unit 3a formats the event data representative of a key-on, a key-off event, a pedal-on event and a pedal-off, a key code data indicative of a key code assigned to the depressed key, a hammer velocity data indicative of the intensity of an impact against a set of strings 13 and a duration data indicative of a lapse of time from an initiation of the performance in accordance with the MIDI (Musical Instrument Digital Interface) standards, and, accordingly, generates a series of music data codes representing the performance. The controlling unit 3a generates electronic sounds from the music data codes in a real time fashion, and/or supplies the music data codes to another electronic sound system.

If a pianist selects the real time sound generation, the controlling unit 3a starts to generate an electronic sound with the note assigned to the depressed key 11a/11b at the impact timing, and regulates the loudness of the electronic sound to the estimated intensity. The electronic sound is terminated at the contact timing. If the timbre of piano tones is selected by a pianist, the electronic sounds generated through the head-phone 4b and/or the speaker sub-system 4c allows the pianist to confirm the fingering on the keyboard 11.

Figure 4:
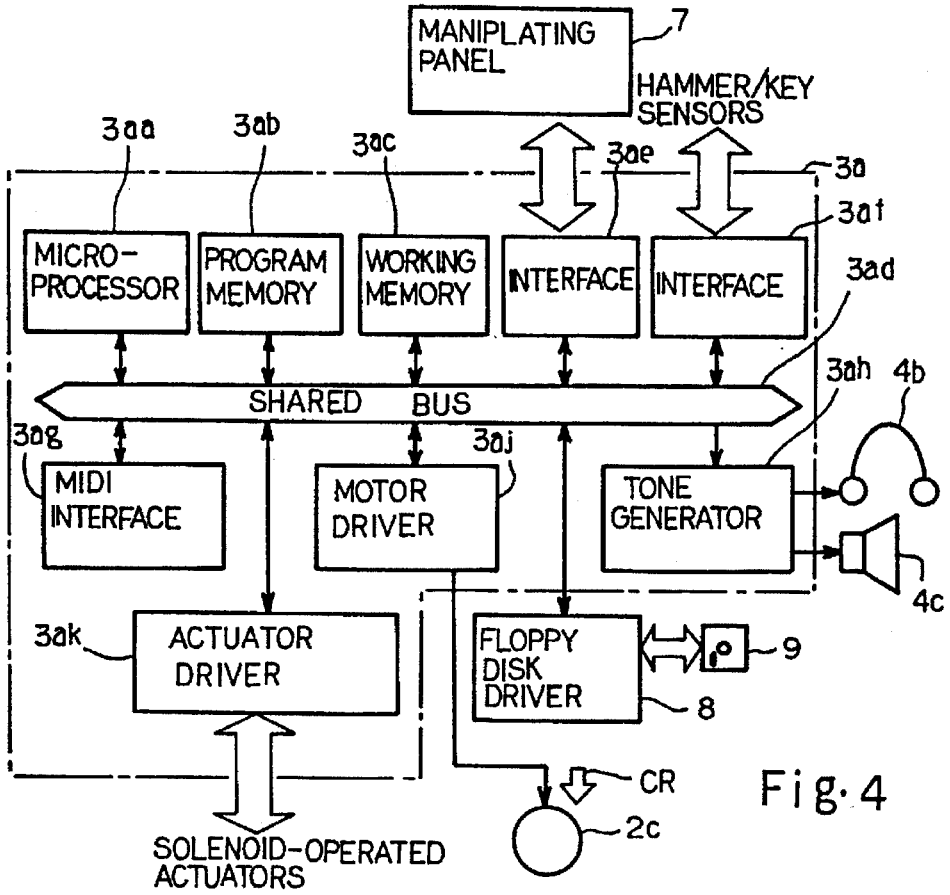
FIG. 4 is a block diagram showing a controlling unit incorporated in the electronic sound system.

Turning to FIG. 4 of the drawings, the controlling unit 3a includes a microprocessor 3aa, a program memory 3ab and a working memory 3ac. The program memory 3ab and the working memory 3ac are implemented by a read only memory device (abbreviated as "ROM") and a random access memory device (abbreviated as "RAM"). The program memory 3ab stores not only instruction codes forming a program sequence but also tables defining the relation between the hammer velocity data and a key velocity. In Mode III, the solenoid-operated actuator unit 3b moves the associated key 11a/11b at the key velocity corresponding to the hammer velocity to be expected.

The working memory 3ac provides a temporary data storage to the microprocessor 3aa. The music data codes and control data codes are, by way of example, memorized in the temporary data storage.

The microprocessor 3aa sequentially fetches the instruction codes through a shared bus 3ad, and executes the program sequence for Mode II, Mode III, Mode IV and Mode V.

The controlling unit 3a further includes interfaces 3ae, 3af and 3ag coupled to the shared bus 3ad, and the microprocessor 3aa periodically scans these interfaces 3ae to 3ag through a main routine.

The interface 3ae is assigned to a manipulating panel 7, and transfers instructions supplied through the switches to the microprocessor 3aa. The switches on the manipulating panel 7 are described hereinlater with reference to FIG. 5.

The interface 3af is assigned to the hammer sensors 4a and the key sensors 4d, and transfers the hammer position signals HP and the key position signals KP to the microprocessor 3aa.

The interface 3ag is called as "MIDI Interface", and the music data codes are transferred through the MIDI interface 2ag to and from an external musical instrument.

The controlling unit 3a further includes a tone generator 3ah which produces an analog audio signal from the music data codes. The tone generator 3ah stores not only tone waveform data for the timbre of the acoustic piano sounds but also tone waveform data for the other timbres, and the microprocessor 3aa instructs the tone generator 3ah to tailor the analog audio signal for one of the tone waveforms in response to the switch on the manipulating panel. The analog audio signal is supplied to the head-phone 4b and the speaker sub-system 4c, and the pianist hears the electronic sounds through them in Mode II or Mode V.

The controlling unit 3a is further communicable with the floppy disk driver 8. A floppy disk 9 is inserted into the floppy disk driver 8, and the floppy disk driver 8 writes the music data codes into and reads out them from the floppy disk 9. Namely, the microprocessor 3a responds to an instruction signal indicative of Mode IV, and transfers the music data codes to the floppy disk driver 8. The floppy disk driver 8 sequentially writes the music data codes into the floppy disk 9 in Mode IV. On the other hand, when Mode III or V is selected, the microprocessor 3a instructs the floppy disk driver 8 to transfer the music data codes to the working memory 3ac, and the microprocessor 3a determines the actuated key 11a/11b and the amount of driving current on the basis of the music data codes.

The controlling unit 3a further includes a motor driver 3aj and an actuator driver 3ak. These drivers 3aj to 3ak are a kind of interface.

The motor driver 3aj is connected to the motor unit 2c, and supplies electric current CR thereto. In detail, when a player selects Mode II, the microprocessor 3a instructs the motor driver 3aj to rotate the motor unit 2c in one direction so as to change the cushion units 2b from the free position FP to the blocking position. On the other hand, when the player selects Mode I, III or V, the microprocessor 3a instructs the motor driver 3aj to rotate the motor unit 2a in the opposite direction, and the cushion units 2b are changed to the free position FP. The cushion units 2b can take either position FP or BP in Mode V depending upon the selection of the player.

The actuator driver 3ak is connected to the solenoid-operated actuators 3b, and selectively supplies the driving current under the control of the microprocessor 3aa.

FIG. 5 illustrates the manipulating panel 7, and the manipulating panel 7 may be embedded into an upper front board of the acoustic piano 1.

A timbre selecting switch array 7a and a display window 7b are provided on the manipulating panel 7. The timbre selecting switch array 7a contains ten keys "0" to "9", an increment key "+" and a decrement key "–", and the different timbres are coded so that a player identifies one of the timbres by using the ten keys and/or the increment/decrement key. The code representative of the selected timbre is displayed on the display window 7b.

The recording switch 7c is further provided on the manipulating panel 7, and a player instructs the keyboard musical instrument to enter into Mode IV by depressing the recording switch 7c. If the player depresses the recording key 7c in Mode IV, the keyboard musical instrument exits from Mode IV.

The playback switch 7d is further provided on the manipulating panel 7, and a manipulation on the playback switch 7d causes the keyboard musical instrument to enter into and exit from Mode III.

The silent switch 7e is further provided on the manipulating panel 7, and the motor unit 2c changes the cushion units 2b between the free position FP and the blocking position BP through the manipulation of the silent switch 7e.

A cancel switch 7f is further provided on the manipulating panel 7. When a player manipulates the cancel switch 7f, the microprocessor 3aa does not instruct the actuator driver 3ak to produce the driving current signal DR, and transfers the music data codes from the working memory 3ab to the tone generator 3ah. The tone generator 3ah tailors the audio signal from the music data codes, and the head-phone 4b and/or the speaker sub-system 4c reproduces the electronic sound.

The keyboard musical instrument has sixteen MIDI channels, and different timbres are independently assigned to the sixteen MIDI channels through the key array 7a.

Keyboard channel switches 7g are provided on the manipulating panel 7, and a player assigns one of the sixteen MIDI channels to the keyboard 11. Light-emitting diodes 7h are respectively corresponding to the keyboard channel switches 7g, and the selected keyboard channel is indicated by the light-emitting diodes 7h.

Playback channel switches 7i are further provided on the manipulating panel 7, and are associated with light-emitting diodes 7j, respectively. The music data codes are supplied through a selected playback channel to the tone generator 3ah, and a player selects the playback channel by manipulating the playback channel switches 7i. The light-emitting diodes 7j is indicative of the selected playback channel.

Image position regulating switches 7k are further provided on the manipulating panel 7, and a player regulates an image of the electronic sounds reproduced from the head-phone 4b or the speaker sub-system 4c to an appropriate position.

A switch 7m and increment/decrement keys 7n are shared between a volume regulation and a parameter regulation such as a timbre. The parameters are selected by manipulating switches 7o, and light-emitting diodes 7p indicates the parameter now under the regulation. The volume and the timbre are displayed on a display window 7q.

Electronic Sound System

The controlling unit 3a, the hammer sensors 4a, the key sensors 4d, the head-phone 4b and/or the speaker system 4c as a whole constitute the electronic sound system 4. The electronic sound system 4 generates electronic sounds in Mode II.

When a player depresses one of the black and white keys 11a/11b in Mode II or IV, the depressed key 11a/11b actuates the associated key action mechanism 16, and the key action mechanism 16 causes the damper head 17e to leave the set of strings 13. The jack 16e rotates the hammer assembly 18 toward the set of strings 13, and the hammer assembly 18 escapes from the jack 16e. Then, the jack 16e starts a free rotation toward the strings 13, and the shutter plate 4e intersects the light beam twice.

The hammer sensor 4a changes the hammer position signal HP twice, and the microprocessor 3aa identifies the depressed key 11a/11b. The microprocessor 3aa further calculates the hammer velocity on the basis of the lapse of time between the first intersection and the second intersection. The microprocessor 3aa determines the key code data and the hammer velocity data, and generates the music data codes. The microprocessor 3aa supplies the music data codes to the tone generator 3ah, and the tone generator 3ah tailors an audio signal. The audio signal is supplied to the head-phone/speaker sub-system 4b/4c, and the head-phone/speaker sub-system 4b/4c generates an electronic sound.

While the key 11a/11b is traveling toward the end position, the shutter plate 4k sequentially intersects the light beams of the associated key sensor 4d. On the other hand, the shutter plate 4k allows the light beams to bridge over the gap after the release of the key 11a/11b. The microprocessor 3aa acknowledges the release of the key 11a/11b or the key-off event on the basis of the key position signal KP, and generates the music data code. The music data code is supplied to the tone generator 3ah, and the tone generator 3ah decays the audio signal. As a result, the head-phone/speaker sub-system 4b/4c terminates the electronic sound. Thus, the electronic sound system 4 generates the electronic sounds on the basis of the hammer/key position signals HP/KP.

Recording System

The recording system 5 includes the controlling unit 3a, the hammer sensors 4a, the key sensors 4d, the floppy disk driver 8 and the recording switch 7c, and is activated in Mode IV. The controlling unit 3a generates the music data codes as similar to those in Mode II. The music data codes are transferred to the floppy disk driver 8, and the floppy disk driver 8 writes the music data codes into the floppy disk 9.

Sound Reproducing System

The floppy disk driver 8, the controlling unit 3a, the cancel switch 7f and the head-phone/speaker sub-system 4b/4c as a whole constitute the sound reproducing system 6, and the sound reproducing system 6 is activated in Mode V. The floppy disk driver 8 successively reads out the music data codes from the floppy disk 9, and supplies the read-out music data codes to the microprocessor 3aa. The microprocessor 3aa transfers the music data codes to the tone generator 3ah, and the tone generator 3ah tailors the audio signal as similar to Mode II. The head-phone/speaker sub-system 4b/4c reproduces the electronic sounds.

Behavior of Keyboard Musical Instrument

Mode I

Description is hereinbelow made on the behavior of the keyboard musical instrument in Mode I.

First, a player is assumed to perform a piece of music through the acoustic sounds. The player does not manipulate the silent switch 7e, and the controlling unit 3a maintains the cushion units 2b in the free position FP.

When the player depresses the white key 11a in the performance, the capstan button 11d pushes up the whippen assembly 16c, and the whippen assembly 16c and the jack 16e are rotated around the whippen flange 16a in the clockwise direction.

The damper spoon 17c declines, and urges the damper lever 17b to rotate in the counter clockwise direction against the damper spring 17f. The damper head 17e leaves the strings 13, and the strings 13 becomes ready for vibrations.

The jack 16e is not rotated around the jack flange 16d until the toe 16g is brought into contact with the regulating button 16j. For this reason, the jack 16e pushes the hammer assembly 18, and rotates it in the clockwise direction around the butt flange 18b.

When the toe 16g is brought into contact with the regulating button 16j, the rotating whippen assembly 16b causes the jack 16e to quickly turn in the counter clockwise direction around the jack flange 16d, and the hammer butt 18 escapes from the jack 16e.

After the escape from the jack 16e, the hammer assembly 18 rushes toward the set of strings 13. However, the cushion units 2b in the free position FP does not interrupts the rotation of the catcher 18e. The hammer head 18d strikes the strings 13, and the strings 13 vibrate so as to generate an acoustic sound.

The hammer head 18d rebounds on the set of strings 13, and returns toward the home position. The catcher 18e is brought into contact with the back check 18f.

When the player releases the key 11a, the capstan button 11d is downwardly moved, and the whippen assembly 16b, the damper spoon 17c and the back check 18f are rotated in the counter clockwise direction around the flange 16a. The damper spring 17f urges the damper lever 17b in the clockwise direction, and the damper head 17e is brought into contact with the strings 13 again. The damper head 17e takes up the vibrations of the strings 13. The back check 18f allows the jack 16e to return to the home position beneath the butt skin 18j.

The absorber 18n decelerates the hammer assembly 18, and softly recovers the hammer assembly 18 to the hole position.

Mode II

When the player wants to perform a piece of music without an acoustic sound, the manipulates the silent switch 7e, and the controlling unit 3a changes the cushion units 2b to enter into the blocking position BP.

While the player is performing a piece of music, the player is assumed to depress the white key 11b, and the associated key action mechanism 16, the damper mechanism 17 ad the hammer assembly 18 behave as similar to those in Mode I until the escape from the jack 16e.

After the escape, the hammer head 18d rushes toward the set of strings 13, and the catcher 18e turns in the clockwise direction together with the hammer butt 18a.

The shutter plate 4e intersects the light beam twice. However, the catcher 18e rebounds on the cushion unit 2b before the hammer head 18d reaches the strings 13. Thus, the silent system 2 prevents the set of strings 104 from the strike of the hammer head 18d, and the set of strings 13 do not vibrate.

The hammer assembly 18 escapes from the jack 16e, and the player feels the key touch usual.

After the release of the key 11a, the hammer assembly 18 returns to the home position as similar to that in Mode I.

The intersection of the light beam changes the hammer position signal HP, and the microprocessor 3aa determines the key code assigned to the depressed key 11a, the hammer velocity and the timing for generating the electronic sound. The microprocessor 3aa generates the music data codes, and transfers them to the tone generator 3ah. The tone generator 3ah tailors the audio signal, and the head-phone/speaker sub-system 4b/4c generates the electronic sound from the audio signal.

After the release of the depressed key 11a, the key sensor 4d changes the key position signal KP, and the microprocessor 3aa determines the key code assigned to the released key 11a and the timing for extinguishing the electronic sound. These data are also coded into the music data code, and the microprocessor 3aa transfers it to the tone generator 3ah. The tone generator 3ah recovers the audio signal to zero level, and the head-phone/speaker sub-system 4b/4c extinguishes the electronic sound.

The microprocessor can transfer the music data codes through the MIDI interface 3ag to an external electronic sound generator (not shown) in Mode II.

Mode III

When a player manipulates the playback switch 7d, the microprocessor 3aa instructs the floppy disk driver 8 to read out the music data codes representative of a selected piece of music from the floppy disk 9, and the floppy disk driver 8 transfers the music data codes to the working memory 3ac.

The microprocessor 3aa checks the duration data, and sequentially reads out the music data codes from the working memory through an interruption handling routine. The interruption handling routine takes place twenty four times per a quarter note. The duration data allows the microprocessor 3aa to read out the music data codes on time base.

When the event data is read out, the microprocessor 3aa executes the flow chart shown in FIG. 6. In detail, when the microprocessor 3aa fetches the event data, the microprocessor 3*aa* determines whether or not the event data represents the key-on event or the key-off event as by step SP10.

If the answer at step SP10 is given negative, the microprocessor 3*aa* proceeds to step SP11, and executes the job represented by the event data.

On the other hand, if the answer at step SP10 is given affirmative, the microprocessor 3*aa* checks a flag representative of the status of the cancel switch 7*f* to see whether or not the player manipulates the cancel switch 7*f*. The cancel switch was not manipulated for Mode III, and the answer at step SP12 is given negative. Then, the microprocessor 3*aa* proceeds to step SP13.

If the event data is representative of the key-on event, the microprocessor 3*aa* instructs the actuator driver 3*ak* to regulate the driving current signal DR to an appropriate value equivalent to the hammer velocity and supply the driving current signal DR to the solenoid-operated actuator unit 3*b* provided beneath the key 11*a*/11*b* to be depressed. With the driving current signal DR, the solenoid-operated actuator unit 3*b* projects the plunger 3*c*, and moves the key 11*a*/11*b* as if the player depresses it. The key 11*a*/11*b* actuates the key action mechanism 16, the damper mechanism 17 as similar to those in Mode I, and the key action mechanism 16 makes the hammer assembly 18 rotated toward the strings 13. The hammer head 18*d* strikes the strings 13, and the strings 13 generates the acoustic sound. After the projection of the plunger 3*c*, the actuator driver 3*ak* maintains the plunger 3*c* at the end position.

On the other hand, if the event data is representative of the key-off event, the actuator driver 3*ak* decreases the driving current signal DR, and the solenoid-operated actuator unit 3*b* retracts the plunger 3*c* into the solenoid case 3*d*. The key 11*a*/11*b* returns from the end position to the rest position, and the key action mechanism 16 and the damper mechanism 17 behave as similar to those in Mode I.

Subsequently, the microprocessor 3*aa* transfers the music data codes to the tone generator 3*ah* as by step SP14. The tone generator 3*ah* tailors the audio signal, and the head-phone/speaker sub-system 4*b*/4*c* reproduces the electronic sound. However, if the player decreases the volume of the electronic sounds to zero, only the acoustic sounds are heard from the keyboard musical instrument.

Thus, the microprocessor 3*aa* executes the interruption handling routine upon every fetch of the event data, and the automatic playing system 3 reproduces the performance represented by the music data codes.

Mode IV

When a player manipulates the recording switch 7*c*, the keyboard musical instrument enters into Mode IV. While the player is performing a piece of music in Mode I or II, the microprocessor 3*aa* transfers the music data codes to the floppy disk driver 8, and the floppy disk driver 8 writes the music data codes into the floppy disk 9.

Mode V

When a player manipulates the cancel switch 7*f*, the microprocessor 3*aa* rises the flag in the working memory 3*ac*, and the keyboard musical instrument enters into Mode V. The microprocessor 3*aa* instructs the floppy disk driver 8 to read out the music data codes from the floppy disk 9, and the floppy disk driver 8 transfers the read-out music data codes to the working memory 3*ac*.

The microprocessor 3*aa* checks the duration data, and fetches the music data code through the interruption handling routine on the time base as similar to Mode III.

When the microprocessor 3*aa* fetches the event data, the microprocessor 3*aa* enters into the interruption handling routine. In Mode V, the answer at step SP12 is given affirmative, and the microprocessor 3*aa* proceeds to step SP14. The microprocessor 3*aa* transfers the music data codes to the tone generator 3*ah*. However, the microprocessor 3*aa* does not instruct the actuator driver 3*ak* to supply the driving current signal DR to the associated solenoid-operated actuator unit 3*b*.

The tone generator 3*ah* tailors the audio signal, and the head-phone/speaker sub-system 4*b*/4*c* reproduces the electronic sound. Thus, the solenoid-operated actuator unit 3*b* does not move the key 11*a*/11*b*, and the player can fingers on the keyboard 11 so as to perform an ensemble together with the electronic sounds.

If the cushion units 2*b* are in the free position FP, the fingering causes the strings 13 to generate the acoustic sound. However, if the cushion units 2*b* are in the blocking position BP, the microprocessor 3*aa* generates the music data codes from the hammer position signals HP and the key position signals KP, and the tone generator 3*ah* forms the audio signal from the read-out music data codes and the music data codes generated by the microprocessor 3*aa*.

Even if the cushion units 2*b* are in the free position FP, the microprocessor 3*aa* may generate the music data codes from the hammer position signals HP and the key position signals KP. The microprocessor 3*aa* supplies the read-out music data codes and the newly generated music data codes to the tone generator 3*ah* through different channels, and the tone generator 3*ah* forms the audio signal from the read-out music data codes and the newly generated music data codes. As a result, the fingering on the keyboard 11 results in both acoustic and electronic sounds.

In this instance, the automatic playing system 3, the electronic sound system 4, the recording system 5 and the sound reproducing system 6 as a whole constitute an electric system.

As will be appreciated from the foregoing description, the keyboard musical instrument according to the present invention allows a player to perform an ensemble together with the tone generator 3*ah* in Mode V by virtue of the sound reproducing system 6.

Second Embodiment

A keyboard musical instrument of the second embodiment also largely comprises an upright piano, a silent system and an electric system. The upright piano and the silent system are similar to those of the first embodiment. Although an automatic playing system 17 is incorporated in the electric system together with the electronic sound system, the recording system and the sound reproducing system, the automatic playing system 17 is modified as follows. The components corresponding to those of the first embodiment are labeled with the same references in the following description.

Figure 7:
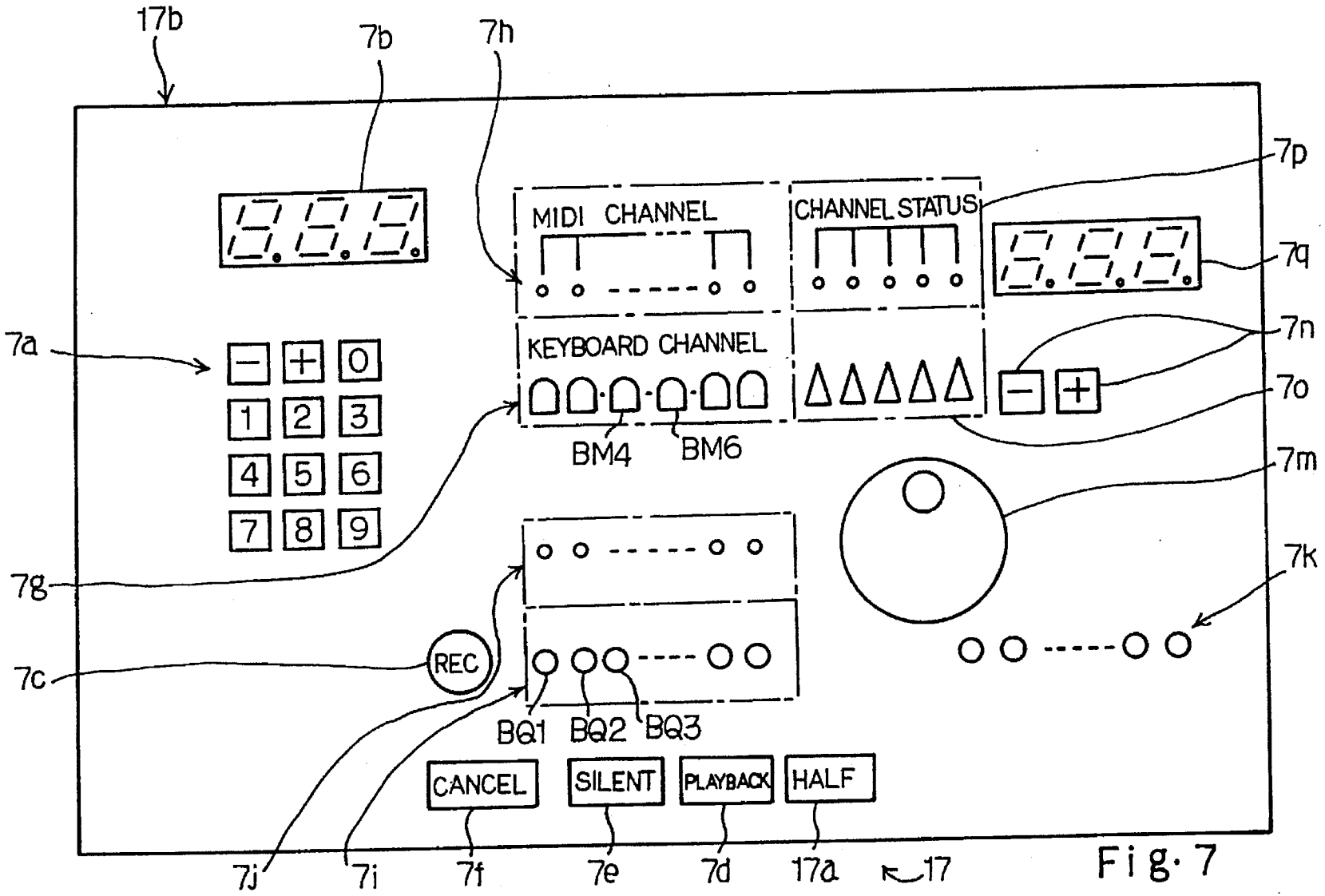
FIG. 7 is a view showing an arrangement of a switches on a manipulating panel incorporated in another keyboard musical instrument according to the present invention.

The automatic playing system 17 includes the controlling unit 3*a*, the solenoid-operated actuator units 3*b*, the playback switch 7*d* and a half-driving switch 17*a* on a manipulating panel 17*b* shown in FIG. 7. When a player manipulates the half-driving switch 17*a*, the microprocessor 3*aa* instructs the actuator driver 3*ak* to supply the driving current signals DR constant but smaller than those represented by the hammer velocities, and the solenoid-operated actuators 3*b* gently rotate the associated keys 11*a*/11*b*. Although the hammer assemblies 18 respectively leave the jacks 16*e*, the hammer heads 18*d* do not reach the strings 13, and an acoustic sound is never generated. However, the microprocessor 3*aa* supplies the music data codes to the tone generator 3*ah*, and the player hears the electronic sounds through the head-phone/speaker sub-system 4*b*/4*c*. The actuation of the solenoid-operated actuators 3b without a manipulation of the half-driving switch 17a is hereinbelow referred to as "half-driving". On the other hand, the actuation under the manipulation of the half-driving switch 17a is called as "full-driving".

Figure 8:
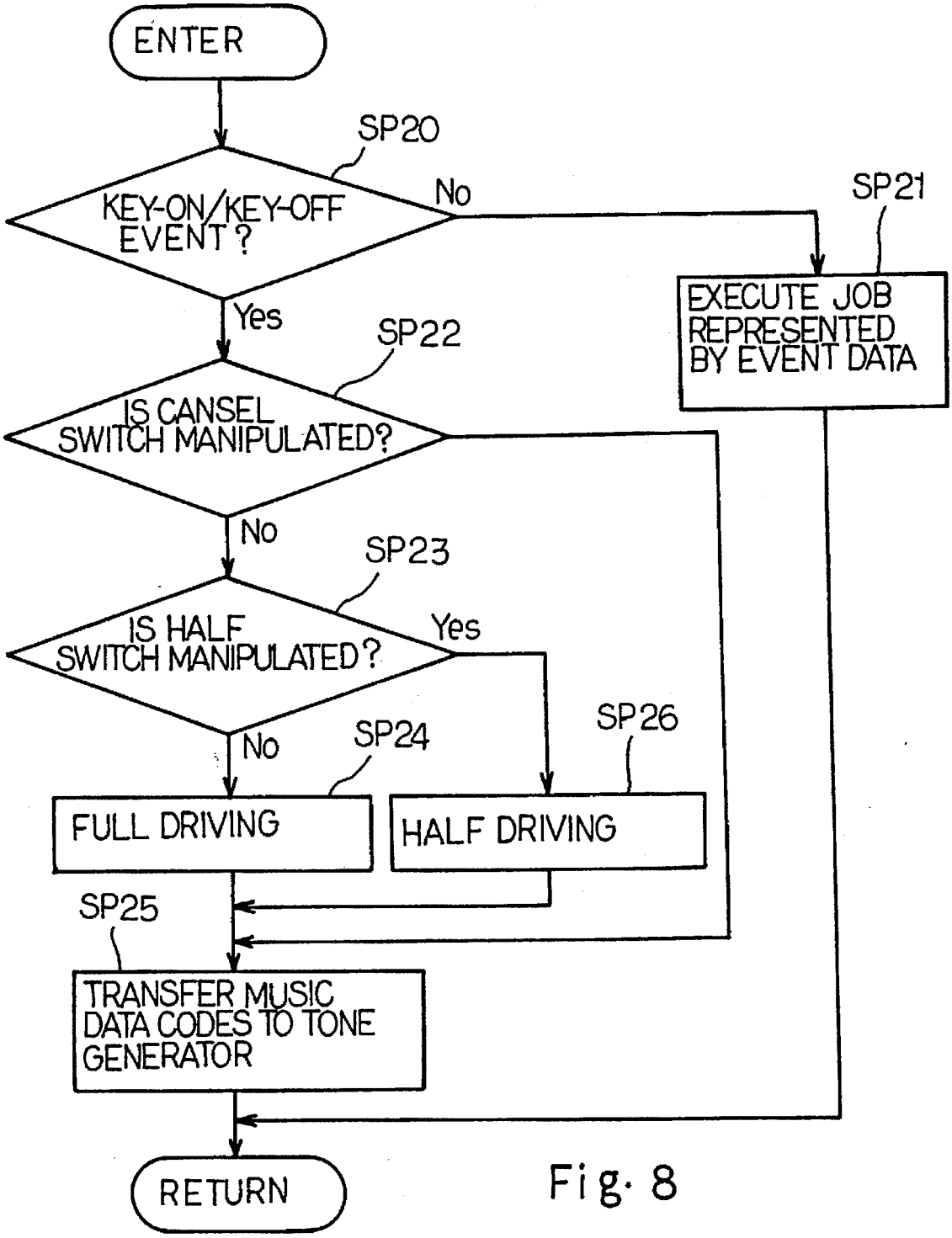
FIG. 8 is a flow chart showing a program sequence executed by a microprocessor incorporated in another keyboard musical instrument upon a read-out of an event data.

FIG. 8 illustrates an interruption handling routine executed by the microprocessor 3aa. When entering into the interruption handling routine, the microprocessor 3aa determines whether or not the event data represents the key-on event or the key-off event as by step SP20.

If the answer at step SP20 is given negative, the microprocessor 3aa proceeds to step SP21, and executes the job represented by the event data.

On the other hand, if the answer at step SP20 is given affirmative, the microprocessor 3aa checks the flag representative of the status of the cancel switch 7f to see whether or not the player manipulates the cancel switch 7f as by step SP22. If the player did not manipulate the cancel switch 7f, the answer at step SP22 is given negative, and the microprocessor 3aa checks a flag representative of the status of the half-driving switch 17a to see whether or not the player manipulates the half-driving switch 17a as by step SP23.

If the player did not manipulate the half-driving switch 17a, the answer at step SP23 is given negative, and the microprocessor 3aa proceeds to step SP24.

If the event data is representative of the key-on event, the microprocessor 3aa instructs the actuator driver 3ak to regulate the driving current signal DR to an appropriate value equivalent to the hammer velocity and supply the driving current signal DR to the solenoid-operated actuator unit 3b provided beneath the key 11a/11b to be depressed as by step SP24. The key to be moved is identified by using the key code, and the hammer velocity is converted to the appropriate value by using a table stored in the program memory 3ab.

With the driving current signal DR, the solenoid-operated actuator unit 3b projects the plunger 3c, and moves the key 11a/11b as if the player depresses it. The key 11a/11b actuates the key action mechanism 16, the damper mechanism 17 as similar to those in Mode I, and the key action mechanism 16 makes the hammer assembly 18 rotated toward the strings 13. The hammer head 18d strikes the strings 13, and the strings 13 generates the acoustic sound. After the projection of the plunger 3c, the actuator driver 3ak maintains the plunger 3c at the end position.

The microprocessor 3aa transfers the music data code to the tone generator 3ah as by step SP25, and the tone generator 3ah tailors and supplies the audio signal to the head-phone/speaker sub-system 4b/4c. When the player wants to hear the acoustic sounds only, he decreases the volume of the electronic sounds to zero. Thereafter, the microprocessor returns to the main routine.

If the player manipulated the cancel switch 7f, the answer at step SP22 is given affirmative, and the microprocessor 3aa directly proceeds to step SP25. The electronic sounds are reproduced through the headphone/speaker sub-system 4b/4c without acoustic sounds. Thereafter, the microprocessor 3aa returns to the main routine.

If the answer at step SP23 is given affirmative, the microprocessor 3aa proceeds to step SP26, and instructs the actuator driver 3ak to carry out the half-driving. The actuator driver 3ak regulates the driving signals DR to a constant value regardless of the hammer velocity, and the constant value is too small to strike the strings 13 with the hammer head 18d.

The microprocessor 3aa transfers the music data code to the tone generator 3ah, and the electronic sounds are reproduced through the head-phone/speaker sub-system 4b/4c as by step SP25. Thereafter, the microprocessor returns to the main routine.

On the other hand, if the event data is representative of the key-off event, the actuator driver 3ak decreases the driving current signal DR, and the solenoid-operated actuator unit 3b retracts the plunger 3c into the solenoid case 3d. The key 11a/11b returns from the end position to the rest position, and the key action mechanism 16 and the damper mechanism 17 behave as similar to those in Mode I.

Thus, the microprocessor 3aa executes the interruption handling routine upon every fetch of the event data, and the automatic playing system 3/the sound reproducing system 6 reproduce the performance represented by the music data codes.

As described hereinbefore, although the hammer assemblies 18 do not strike the strings 13 under the half-driving, the solenoid-operated actuator units 3b cause the keys 11a/11b to sink, and guides the fingers of a pianist. Thus, the half-driving mode makes a trainee easily practice the fingering on the keyboard 11.

Moreover, while the keyboard musical instrument is reproducing a piece of music in the half-driving mode, the keys 11a/11b sink as if an invisible player depresses, and listeners enjoy not only the electronic sounds but also the key motion.

Although particular embodiments of the present invention have been shown and described, it will be obvious to those skilled in the art that various changes and modifications may be made without departing from the spirit and scope of the present invention.

When the key of a standard upright piano sinks by 4 millimeters, the damper spoon 17c starts to push the damper lever 17b, and the reaction increases the load of the solenoid-operated actuator unit 3b. If the solenoid-operated actuator units 3b maintain the black/white keys 11a/11b immediately before the increase of the load, the current consumption is decreased.

When the half-driving switch 17a and the silent switch 7e are manipulated, the catchers 18e rebound on the cushion units 2b, and the microprocessor 3aa generates the music data codes on the basis of the hammer position signals HP and the key position signals KP, and the player can confirm his fingering on the keyboard 11 through the head-phone 4b.

Modification

A keyboard musical instrument according to the present invention allows a player to perform an ensemble as follows. The controlling unit 3aa changes the cushion units 2b to the blocking position BP, and supplies the read-out music data codes to the actuator driver 3ak so as to selectively energize the solenoid-operated actuator units 3b. The solenoid-operated actuator units 3b move the keys 11a/11b, and the key action mechanisms 16 rotate the hammer assemblies 18. The hammer assemblies rebounds before a strike at the strings 13, and the hammer sensors 4a and the key sensors 4d changes the hammer position signals HP and the key position signals KP. The microprocessor 3aa generates the music data codes from the hammer position signals HP and the key position signals KP, and the tone generator 3ah supplies the audio signal to the head-phone 4b and the speaker sub-system 4c.

In this situation, if a player fingers on the keyboard 11, the hammer sensors 4a and the key sensors 4d also change the hammer position signals HP and the key position signals KP, and the microprocessor unit 3aa further generates the music data codes representative of the fingering on the keyboard 11. The tone generator 3*ah* forms the audio signal representative of the part performed by the solenoid-operated actuator units 3*b* and another part performed by the player, and the head-phone 4*b* and/or the speaker sub-system 4*c* generates the electronic sounds for these parts.

However, the electronic sounds representative of the fingering on the keyboard 11 are mixed with the electronic sounds generated from the read-out music data codes, and the mixed sounds may not allow the player to clearly discriminate his part. The microprocessor 3*aa* can discriminate the key/hammer motion actuated by the fingering from the key/hammer motion actuated by the solenoid-operated actuator units 3*b*, and assigns the music data codes representative of one part and the music data codes representative of the other part to different channels. For example, a player assigns the read-out music data codes to the first to third MIDI channels by manipulating the switches BQ1 to BQ3 and the music data codes representative of the fingering on the keyboard to the fourth to sixth MIDI channels by manipulating the switches BM4 to BM6. If the timbres are differently assigned to the electronic sounds through the first to third MIDI channels and the electronic sounds through the fourth to sixth MIDI channels, the player easily discriminates the electronic sounds generated on the basis of the fingering from the reproduced electronic sounds.

The event data may be generated as follows. When the solenoid-operated actuator unit 3*b* moves the key 11*a*/11*b* from the rest position to the end position in the half-driving mode, the key sensor 4*d* detects the key motion, and changes the key position signal KP. In detail, the shutter plate 4*k* successively intersects the upper photo-interrupter and the lower photo-interrupter. The microprocessor 3*aa* acknowledges the key-on event at the first intersection of the light beam radiated from the upper photo-interrupter, and calculates the key velocity from the lapse of time between the first intersection and the second intersection of the light beam radiated from the lower photo-interrupter. On the other hand, when the solenoid-operated actuator unit 3*b* allows the key 11*a*/11*b* to be upwardly moved from the end position to the rest position, the shutter plate 4*k* allows the lower photo-interrupter and, thereafter, the upper photo-interrupter to bridge over the gap between the photo-radiating end of the optical fiber and the photo-receiving end of the other optical fiber. When the lower photo-interrupter bridges over the gap, the microprocessor acknowledges the key-off event.

Figure 9:
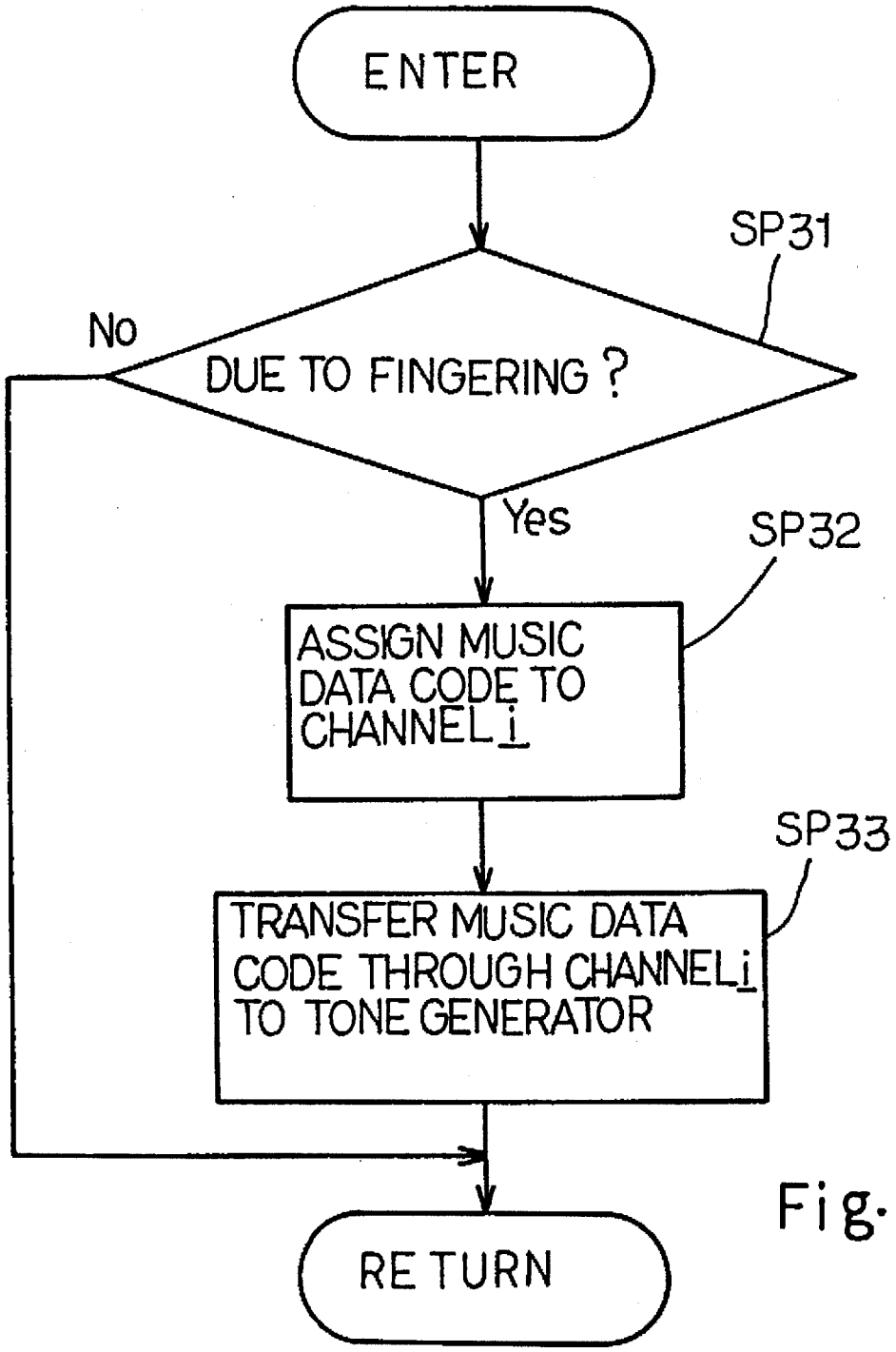
FIG. 9 is a flow chart showing a program sequence executed by a microprocessor incorporated in a modification for discriminating a fingering on a keyboard from actuation by a solenoid-operated actuator unit.

The discrimination between the fingerings and the actuation by the solenoid-operated actuator units 3*b* is carried out as follows. FIG. 9 illustrates the discriminating routine executed by the microprocessor 3*aa* at every key-event.

When the key sensor 4*d* detects a key-event, i.e., the key-on event or the key-off event, the microprocessor 3*aa*, the microprocessor 3*aa* determines whether or not the key event is caused by the fingering on the keyboard 11 as by step SP31. In order to make the decision, the microprocessor 3*aa* estimates the next key-on timing or the next key-off timing from the read-out music data code representative of the hammer velocity, and gives a time margin to the key-on timing or the key-off timing. Thus, the microprocessor 3*aa* firstly determines a time range when the key-on event/key-off event takes place due to the actuation of the solenoid-operated actuator unit 3*b*. If the detected key-on event or the detected key-off event does not fall within the time range, the microprocessor 3*aa* determines that the key-on event or the key-off event is due to the fingering on the keyboard, and the answer at step SP31 is given affirmative.

The microprocessor 3*aa* proceeds to step SP32, and assigns the music data code to the MIDI channel i different from the MIDI channels assigned the read-out music data codes. If the forth MIDI channel to the sixth MIDI channel are available for the music data codes due to the fingerings, the MIDI channel i is selected from these MIDI channels.

Subsequently, the microprocessor 3*aa* transfers the music data code through the MIDI channel i to the tone generator 3*ah* as by step SP33, and the tone generator 3*ah* forms the audio signal from the music data code. After the transfer to the tone generator 3*ah*, the microprocessor 3*aa* returns to the main routine.

On the other hand, if the key-on event or the key-off event falls within the time range, the answer at step SP31 is given negative, and the microprocessor 3*aa* returns to the main routine. The read-out music data code is assigned to the first to third MIDI channels, and the read-out music data code is transferred through the selected MIDI channel to the tone generator 3*ah* (see step SP14 and SP25).

Thus, the read-out music data codes and the music data codes due to the fingering are transferred through the different MIDI channels to the tone generator 3*ah*, and a player can instruct the tone generator 3*ah* to impart different timbres to the electronic sounds. As a result, the player easily discriminates the electronic sounds generated by himself. Moreover, the listeners feel the ensemble as if players perform it in a large concert hall.

The player may impart the timbres of different musical instruments to the electronic sounds. For example, a piece of music may be performed as if a piano and a harpsichord are used.

If the cancel switch 7*f* is manipulated, the solenoid-operated actuator units 3*b* do not move the keys 11*a*/11*b*, and the music data codes due to the fingering are immediately assigned to one of the fourth to sixth MIDI channels.

If the half switch 17*a* is manipulated, the keys 11*a*/11*b* shallowly sink, and the key sensors 4*d* do not detect the key-on event. For this reason, the microprocessor 3*aa* is not expected to discriminate the music data codes due to the fingering from the read-out music data codes, and assigns the music data codes to one of the fourth to sixth MIDI channels.

The microprocessor 3*aa* may assign different pitch ranges, different volumes, different effects or different image positions to the electronic sounds due to the fingering and the electronic sounds produced from the readout music data codes. The position of image is differently changeable by manipulating the dial switches 7*k*.

The key-code, the key-on/key-off and a key velocity may be determined on the basis of the key position signals KP.

In the modification, the microprocessor 3*aa* acknowledges the key events on the basis of the key position signals KP. However, the modification may use the hammer position signals HP.

The music data codes due to the fingering and the read-out music data codes may be fixedly assigned to predetermined MIDI channels.

The microprocessor 3*aa* may transfer the read-out music data code to the tone generator 3*ah* immediately after the negative answer at step SP31 without entrance into the program routine shown in FIG. 6 or FIG. 8.

The music data codes may be supplied from the outside of the keyboard musical instrument to the MIDI interface 3*ag* in Modes III and V.

The pedal may be manipulated as similar to the keys in the half-driving mode.

The hammer shank 18*c* or the hammer head 18*d* may rebound on a stopper.

The cushion units 2*b* may be changed by manipulating a link mechanism.

The acoustic piano may be a grand piano, and the present invention may be applied to another acoustic keyboard musical instrument such as a harpsicode, a celesta and an organ.

What is claimed is:

1. A keyboard musical instrument comprising:

an acoustic keyboard instrument including a keyboard having a plurality of keys assigned notes of a scale and respectively rotated when forces are exerted thereon, a plurality of key action mechanisms respectively connected to said plurality of keys so as to transfer said forces therethrough, a plurality of hammer assemblies respectively associated with said plurality of key action mechanisms, and driven for rotation by said plurality of key action mechanisms transferring said forces thereto, and a plurality of vibrative means respectively struck by said plurality of hammer assemblies driven by said plurality of key action mechanisms for generating acoustic sounds having said notes; and an electric system including a plurality of actuators respectively provided for said plurality of keys and responsive to driving signals for exerting said forces on said plurality of keys, an electronic sound generating means responsive to music data codes for generating electronic sounds, and a controlling means responsive to an instruction supplied from the outside of said keyboard musical instrument so as to selectively enter into an electronic sound mode and an acoustic sound mode, said controlling means supplying said music data codes to said electronic sound generating means in said electronic sound mode, said controlling means generating said driving signals from said music data codes so as to supply said driving signals to said plurality of actuators.

2. The keyboard musical instrument as set forth in claim 1, further comprising a silent system changed between a free position and a blocking position, said silent system in said free position allowing said plurality of hammer assemblies to strike said plurality of vibrative means, said silent system in said blocking position causing said plurality of hammer assemblies to rebound thereon before a strike at one of said plurality of vibrative means.

3. The keyboard musical instrument as set forth in claim 1, further comprising a silent system changed between a free position and a blocking position, said silent system in said free position allowing said plurality of hammer assemblies to strike said plurality of vibrative means, said silent system in said blocking position causing said plurality of hammer assemblies to rebound thereon before a strike at one of said plurality of vibrative means, said electric system including:

an automatic playing sub-system having said controlling means for producing said driving signals, and said plurality of actuators respectively provided for said plurality of keys and responsive to said driving signals for exerting said forces to said plurality of keys;

an electronic sound sub-system having a plurality of sensor means for producing position signals representative of motions due to said forces, said controlling means for producing said music data codes from said position signals and said electronic sound generating means responsive to said music data codes so as to generate said electronic sounds; and a sound reproducing sub-system having said controlling means so as to transfer said music data codes from the outside therethrough and said electronic sound generating means responsive to said music data codes for generating said electronic sounds.

4. The keyboard musical instrument as set forth in claim 3, in which said electric system further includes a recording sub-system having said plurality of sensor means, said controlling means for producing said music data codes from said position signals and a data storage means for storing said music data codes.

5. The keyboard musical instrument as set forth in claim 4, in which said data storage means supplies said music data codes to said automatic playing sub-system or said sound reproducing sub-system.

6. The keyboard musical instrument as set forth in claim 3, in which said sound reproducing sub-system further includes said plurality of actuators, and said controlling means selectively supplies said driving signals to said plurality of actuators so as to selectively move said plurality of keys assigned said notes identical with the notes of said electronic sounds.

7. The keyboard musical instrument as set forth in claim 6, in which said plurality of actuators of said sound reproducing sub-system generates said forces smaller than said forces generated by said plurality of actuators incorporated in said automatic playing sub-system.

8. The keyboard musical instrument as set forth in claim 3, in which said sound reproducing sub-system further includes said plurality of sensor means, and said controlling means is further operative to produce said music data codes from said position signals so as to transfer said music data codes produced from said position signals to said electronic sound generating means together with said music data codes supplied from said outside.

9. The keyboard musical instrument as set forth in claim 8, in which said controlling means transfers said music data codes supplied from said outside and said music data codes generated from said position signals through different channels to said electronic sound generating means.

* * * * *